US011988400B2

(12) United States Patent
Xiong et al.

(10) Patent No.: US 11,988,400 B2
(45) Date of Patent: May 21, 2024

(54) AIR-OUTLET DUCT STRUCTURE, AIR-OUTLET PANEL AND PATIO TYPE AIR CONDITIONER INDOOR UNIT

(71) Applicant: Gree Electric Appliances, Inc. of Zhuhai, Guangdong (CN)

(72) Inventors: Jianguo Xiong, Guangdong (CN); Bochun Liu, Guangdong (CN); Junyong Wang, Guangdong (CN); Zhiyao Hu, Guangdong (CN); Jinguo Zeng, Guangdong (CN); Lixuan Gong, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 667 days.

(21) Appl. No.: 17/258,858

(22) PCT Filed: May 17, 2019

(86) PCT No.: PCT/CN2019/087353
§ 371 (c)(1),
(2) Date: Jan. 8, 2021

(87) PCT Pub. No.: WO2020/052264
PCT Pub. Date: Mar. 19, 2020

(65) Prior Publication Data

US 2021/0285660 A1 Sep. 16, 2021

(30) Foreign Application Priority Data

Sep. 14, 2018 (CN) ..... 201811076214.1

(51) Int. Cl.
*F24F 1/0014* (2019.01)
*F24F 1/0047* (2019.01)
*F24F 13/08* (2006.01)

(52) U.S. Cl.
CPC ..... *F24F 1/0014* (2013.01); *F24F 1/0047* (2019.02); *F24F 13/081* (2013.01)

(58) Field of Classification Search
CPC ..... F24F 1/0014; F24F 1/0047; F24F 1/0011; F24F 13/081; F24F 13/06
USPC ..... 454/233
See application file for complete search history.

(56) References Cited

U.S. PATENT DOCUMENTS

2016/0281998 A1 9/2016 Fujita

FOREIGN PATENT DOCUMENTS

| | | | |
|---|---|---|---|
| CN | 1145764 | C | 4/2004 |
| CN | 2826236 | Y | 10/2006 |
| CN | 101210713 | A | 7/2008 |
| CN | 102022781 | A | 4/2011 |
| CN | 101206070 | B | 8/2011 |
| CN | 202835720 | U | 3/2013 |

(Continued)

*Primary Examiner* — Allen R. B. Schult
(74) *Attorney, Agent, or Firm* — The Webb Law Firm

(57) ABSTRACT

An air outlet duct structure, an air outlet panel and a patio type air conditioner indoor unit are provided. The air outlet duct structure includes a first air duct wall and a second air duct wall arranged oppositely. An air outlet passage is formed between the first air duct wall and the second air duct wall. The first air duct wall includes a plurality of concave curved surfaces connected along an airflow direction, wherein curvature radii of the plurality of concave curved surfaces decrease sequentially along the airflow direction.

11 Claims, 4 Drawing Sheets

(56) References Cited

FOREIGN PATENT DOCUMENTS

| | | | | | |
|---|---|---|---|---|---|
| CN | 204388229 | U | | 6/2015 | |
| CN | 104976744 | A | | 10/2015 | |
| CN | 106016452 | A | | 10/2016 | |
| CN | 106678982 | A | * | 5/2017 | ..... F24F 1/0011 |
| CN | 106678982 | A | | 5/2017 | |
| CN | 107044683 | A | | 8/2017 | |
| CN | 110906521 | A | | 3/2020 | |
| EP | 1152193 | A1 | | 11/2001 | |
| JP | 20009098 | A | | 1/2000 | |
| JP | 2003329295 | A | | 11/2003 | |
| JP | 2003329295 | A | * | 11/2003 | |

* cited by examiner

AIR-OUTLET DUCT STRUCTURE, AIR-OUTLET PANEL AND PATIO TYPE AIR CONDITIONER INDOOR UNIT

CROSS-REFERENCE TO RELATED APPLICATIONS

The present disclosure is a U.S. National Stage Application under 35 U.S.C. § 371 of International Patent Application No. PCT/CN2019/087353, filed on May 17, 2019, which claims priority to Chinese Patent Application No. 201811076214.1 titled "AIR OUTLET DUCT STRUCTURE, AIR OUTLET PANEL AND PATIO TYPE AIR CONDITIONER INDOOR UNIT" filed on Sep. 14, 2018, the disclosures of both of which are incorporated by reference herein in their entirety.

BACKGROUND

Field of the Invention

The present disclosure relates to the technical field of an air conditioning device, in particular to an air outlet duct structure, an air outlet panel and a patio type air conditioner indoor unit containing the same.

Description of Related Art

The patio type air conditioner indoor unit, also known as a ceiling unit or a ceiling-mounted type, is an embedded air conditioner. Since the patio type air conditioner indoor unit may save space whilst producing an aesthetic effect, it is widely applied. The air outlet duct structure at a corner of the traditional patio type air conditioner indoor unit is present with the problem of poor air induction capacity, thereby resulting in a small final air volume.

SUMMARY OF THE INVENTION

On this account, one of the objects of the present disclosure is to provide an air outlet duct structure, an air outlet panel, and a patio type air conditioner indoor unit to solve the problem of poor air induction capacity and small air volume in the art known to inventors.

In order to achieve the above-described object, in one aspect, the embodiments of the present disclosure use the following technical solution: an air outlet duct structure, including a first air duct wall and a second air duct wall arranged oppositely, wherein an air outlet passage is formed between the first air duct wall and the second air duct wall, the first air duct wall includes a plurality of concave curved surfaces connected along an airflow direction, and curvature radii of the plurality of concave curved surfaces decrease sequentially along the airflow direction.

In some embodiments, the plurality of concave curved surfaces include a first concave curved surface and a second concave curved surface, where a curvature radius of the first concave curved surface is R1, and a curvature radius of the second concave curved surface is R2, wherein a relationship between R1 and R2 is: $R1=k1*R2$, $1.5\leq k1\leq 2$; and, 150 mm$\leq$R1$\leq$250 mm, 50 mm$\leq$R2$\leq$150 mm; or $R1=k1*R2$, $1.5\leq k1\leq 2$; or, 150 mm$\leq$R1$\leq$250 mm.

In some embodiments, the second air duct wall includes a third concave curved surface disposed proximate to an air outlet of the air outlet duct, and a curvature radius of the third concave curved surface is R, wherein a relationship between R and R2 is: $R=k2*R2$, $3\leq k2\leq 4$; and, 150 mm$\leq$R$\leq$550 mm; or $R=k2*R2$, $3\leq k2\leq 4$; or, 150 mm$\leq$R$\leq$550 mm.

In the air outlet air duct structure provided by the embodiments of the present disclosure, a plurality of connected concave curved surfaces are designed on the first air duct wall along an airflow direction, and curvature radii of the plurality of concave curved surfaces decrease sequentially along the airflow direction, thereby enhancing the air induction capacity, and further achieving the purpose of increasing the air volume. At the same time, it is possible that the structure of the air outlet duct may be flexibly handled.

In another aspect, the embodiments of the present disclosure use the following technical solution: an air outlet panel, including a panel body and a corner cover plate disposed at a corner of the panel body, wherein the corner cover plate and the panel body constitute the air outlet duct structure, a part of a lateral surface of the panel body constitutes the first air duct wall, and a part of a lateral surface of the corner cover plate constitutes the second air duct wall, and a corner air outlet of the air outlet panel is formed between the corner cover plate and the panel body.

In some embodiments, one end of the corner cover plate proximate to a center of the air outlet panel is closer to the center of the air outlet panel than one end of the panel body away from the center of the outlet panel; or, in a direction from a center of the air outlet panel to an outer edge of the air outlet panel, one end of the corner cover plate proximate to a center of the air outlet panel is adjacent to one end of the panel body away from the center of the air outlet panel.

In some embodiments, the air outlet panel is an air outlet panel of a patio type indoor unit, and the lowest point of the corner cover plate is set higher than the lowest point of the panel body.

In some embodiments, a flow guide structure is provided between the corner cover plate and the panel body.

In some embodiments, in a direction from a center of the air outlet panel to an outer edge of the air outlet panel, the flow guide structure partially overlaps with the panel body and the corner cover plate, or the flow guide structure partially overlaps with the panel body or the corner cover plate; or, in a direction from a center of the air outlet panel to an outer edge of the air outlet panel, one end of the flow guide structure proximate to a center of the air outlet panel is adjacent to one end of the panel body away from the center of the air outlet panel, and, one end of the flow guide structure away from the center of the air outlet panel is adjacent to one end of the corner cover plate proximate to the center of the air outlet panel; or in a direction from a center of the air outlet panel to an outer edge of the air outlet panel, one end of the flow guide structure proximate to a center of the air outlet panel is adjacent to one end of the panel body away from the center of the air outlet panel, or, one end of the flow guide structure away from the center of the air outlet panel is adjacent to one end of the corner cover plate proximate to the center of the air outlet panel.

In some embodiments, in the direction from a center of the air outlet panel to the outer edge of the air outlet panel, a size of an overlapping portion of the flow guide structure and the panel body is less than or equal to 2 mm; and, in the direction from the center of the air outlet panel to the outer edge of the air outlet panel, a size of an overlapping portion of the flow guide structure and the corner cover plate is less than or equal to 2 mm; or in the direction from the center of the air outlet panel to the outer edge of the air outlet panel, a size of an overlapping portion of the flow guide structure and the panel body is less than or equal to 2 mm; or, in the direction from the center of the air outlet panel to the outer edge of the air outlet panel, a size of an overlapping portion of the flow guide structure and the corner cover plate is less than or equal to 2 mm.

In some embodiments, the flow guide structure includes one flow guide plate or a plurality of flow guide plates arranged along an airflow direction.

In some embodiments, the flow guide plate is connected to the corner cover plate through a connecting portion.

In some embodiments, the raised structure includes a plurality of strip-like protrusions.

In some embodiments, in a direction from a center of the air outlet panel to an outer edge of the air outlet panel, the plurality of strip-like protrusions are arranged at intervals from each other.

The air outlet duct structure provided by the embodiments of the present disclosure presents a large air outlet volume.

In another aspect, the embodiments of the present disclosure use the following technical solution: a patio type air conditioner indoor unit, including the above-described air outlet panel.

The patio type air conditioner indoor unit provided by the embodiments of the present disclosure presents a large air volume.

In some embodiments, a raised structure is provided on a leeward surface of the flow guide plate.

In some embodiments, the air outlet panel is an air outlet panel of a patio type air conditioner indoor unit, and an included angle between the flow guide plate and a horizontal plane is greater than or equal to 0° and less than 90°

BRIEF DESCRIPTION OF THE DRAWINGS

The above-described and other objects, features, and advantages of the embodiments of the present disclosure will be more apparent from the following description of embodiments of the present disclosure in conjunction with the accompanying drawings, in which.

DETAILED DESCRIPTION OF THE INVENTION

The present disclosure will be described below based on the embodiments. However, the present disclosure is not only limited to these embodiments. In order to avoid obscuring the essence of the present disclosure, well-known methods, processes, procedures, and elements are not described in detail.

In addition, those skilled in the art should understand that the drawings provided here are for the purpose of illustration, and the drawings are not necessarily drawn to scale.

Unless specifically required in the context, the words "comprising", "including", and the like throughout the specification and claims should be interpreted as inclusive rather than exclusive or exhaustive, that is, the meaning of "including but not limited to".

In the description of the present disclosure, it should be understood that, the terms "first", "second", and the like are used for descriptive purposes only, and cannot be understood to indicate or imply relative importance. In addition, in the description of the present disclosure, unless otherwise stated, the meaning of "a plurality of" is two or more.

Embodiment 1

Figure 1:
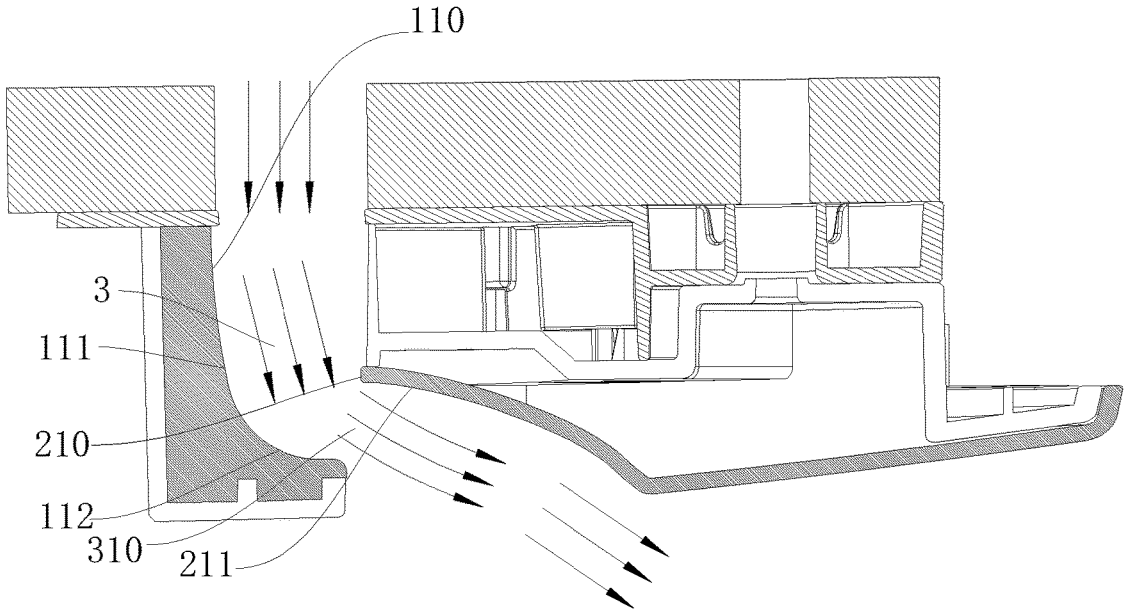
FIG. 1 shows the structure of the air outlet duct described in Embodiment 1.

As shown in FIG. 1, an air outlet duct structure includes a first air duct wall 110 and a second air duct wall 210 that are arranged oppositely, wherein an air outlet passage 3 is formed between the first air duct wall 110 and the second air duct wall 210. The first air duct wall 110 includes a plurality of concave curved surfaces connected along an airflow direction, and curvature radii of the plurality of concave curved surfaces decrease sequentially along the airflow direction.

In the case where the depth of the air outlet passage 3 is relatively large, the first air duct wall 110 includes a plurality of concave curved surfaces connected along an airflow direction, so that the air outlet passage 3 may be flexibly handled to achieve an expected effect of a maximum air outlet volume. In the present embodiment, preferably, the plurality of concave curved surfaces include a first concave curved surface 111 and a second concave curved surface 112, wherein a curvature radius of the first concave curved surface 111 is R1, and a curvature radius of the second concave curved surface 112 is R2.

R1 and R2 are tangent at their connection position to form a smooth curved surface so as to avoid blocking the air. Preferably, R1 and R2 satisfy such a relationship that: $R1=k1*R2$, $1.5\leq k1\leq 2$, where k1 is preferably 2, so as to achieve a better air outlet effect; $150\text{ mm}\leq R1\leq 250\text{ mm}$, $50\text{ mm}\leq R2\leq 150\text{ mm}$, where a central angle of R1 is preferably 25°-45°, and a central angle of R2 is preferably 25°-75°.

The second air duct wall 210 includes a third concave curved surface 211 disposed proximate to the air outlet 310 of the air outlet passage 3, and a curvature radius of the third concave curved surface 211 is R. Preferably, R and R2 satisfy such a relationship that: $R=k2*R2$, $3\leq k2\leq 4$, where k2 is preferably 4; $150\text{ mm}\leq R\leq 550\text{ mm}$, where a central angle of R is in the range of 18°-66°. The third concave curved surface 211 may not only reduce blocking to air flowing through the air outlet, reduce the air resistance, and increase the air volume, but also produce a more aesthetic effect. It is obtained by experiments and tests that in the absence of other abnormalities, such as condensation at the air outlet, the size of the third concave curved surface 211 reaches a maximum and the air volume reaches the effect of a maximum value. The verification data approximately consists in that: when the size of a single air outlet decreases by 5 mm, the air volume of a single air outlet decreases by 7 $m^3/h$ and the curvature radius is 150 mm, the central angle is 66°, and when the curvature radius is 550 mm, the central angle is 18°. In actual application process, the data may vary according to the size of the patio type air conditioner.

When air flows inward from the air inlet of the air outlet passage 3, a part of the air flowing inward flows to the third concave curved surface 211 under the blocking of the second concave curved surface 112, and the air flowing to the third concave curved surface 211 can cool the third concave curved surface 211, so as to avoid condensation.

Embodiment 2

Figure 2:
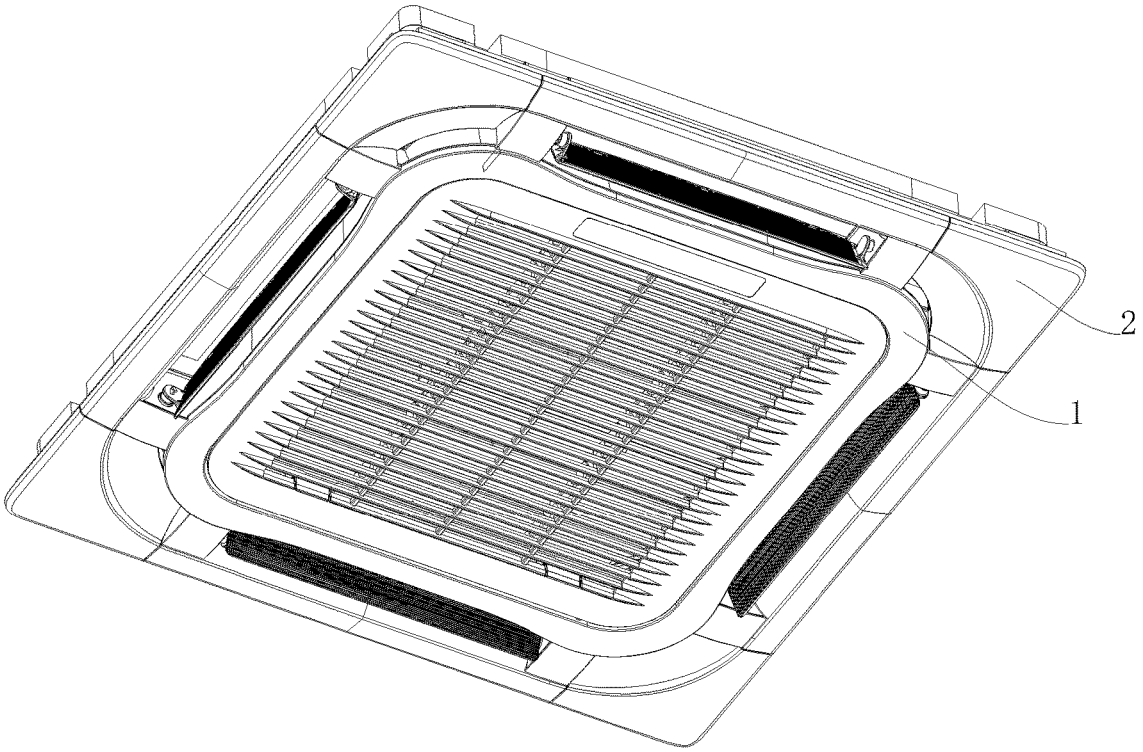
FIG. 2 shows the air outlet panel described in Embodiment 2.
Figure 3:
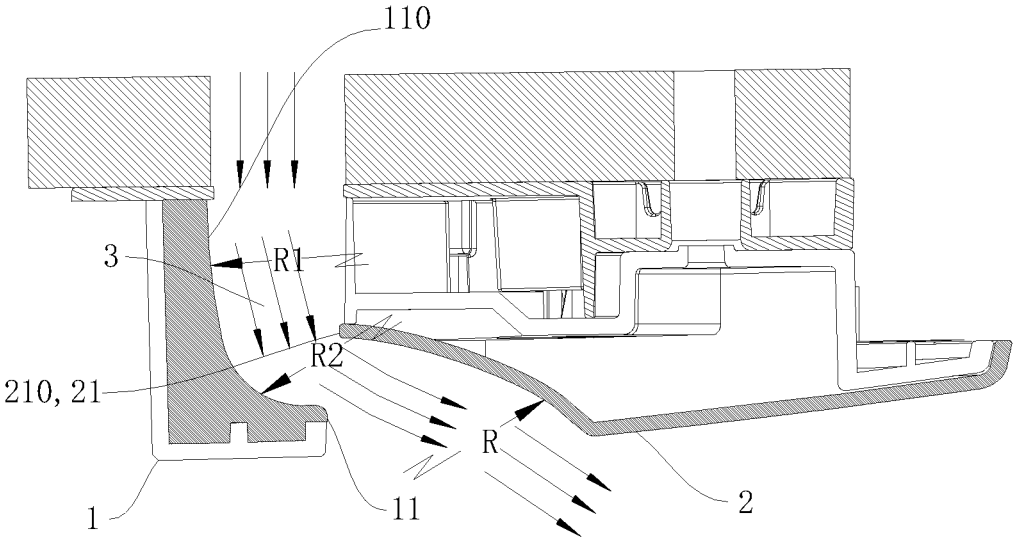
FIG. 3 shows a cross-sectional view of a partial structure of the air outlet panel shown in FIG. 2.

As shown in FIGS. 2 and 3, an air outlet panel includes a panel body 1 and a corner cover plate 2 arranged at a corner of the panel body 1. The corner cover plate 2 and the panel body 1 constitute the air outlet duct structure, a part of a lateral surface of the panel body 1 constitutes the first air duct wall 110, and a part of a lateral surface of the corner cover plate 2 constitutes the second air duct wall 210, and a corner air outlet of the air outlet panel is formed between the corner cover plate 2 and the panel body 1.

One end 21 of the corner cover plate 2 proximate to a center of the air outlet panel is arranged closer to the center of the air outlet panel than one end 11 of the panel body 1 away from the center of the air outlet panel, or in a direction from a center of the air outlet panel to an outer edge of the air outlet panel, one end 21 of the corner cover plate 2 proximate to the center of the air outlet panel is adjacent to one end 11 of the panel body 1 away from the center of the air outlet panel. In this way, it is possible to ensure that the air streams are all required to flow out from the corner air outlet after a flow guiding effect of the panel body 1, thereby effectively avoiding condensation problem (thus, when one end 21 of the corner cover plate 2 proximate to the center of the air outlet panel is not adjacent to one end 11 of the panel body 1 away from the center of the air outlet panel, but with a gap therebetween, some of the airflows may flow out directly from the gap; the larger the gap is, the weaker the flow guiding effect will be; the less the air streams pass through the corner cover plate 2, the more easily condensation will happen).

Embodiment 3

Figure 4:
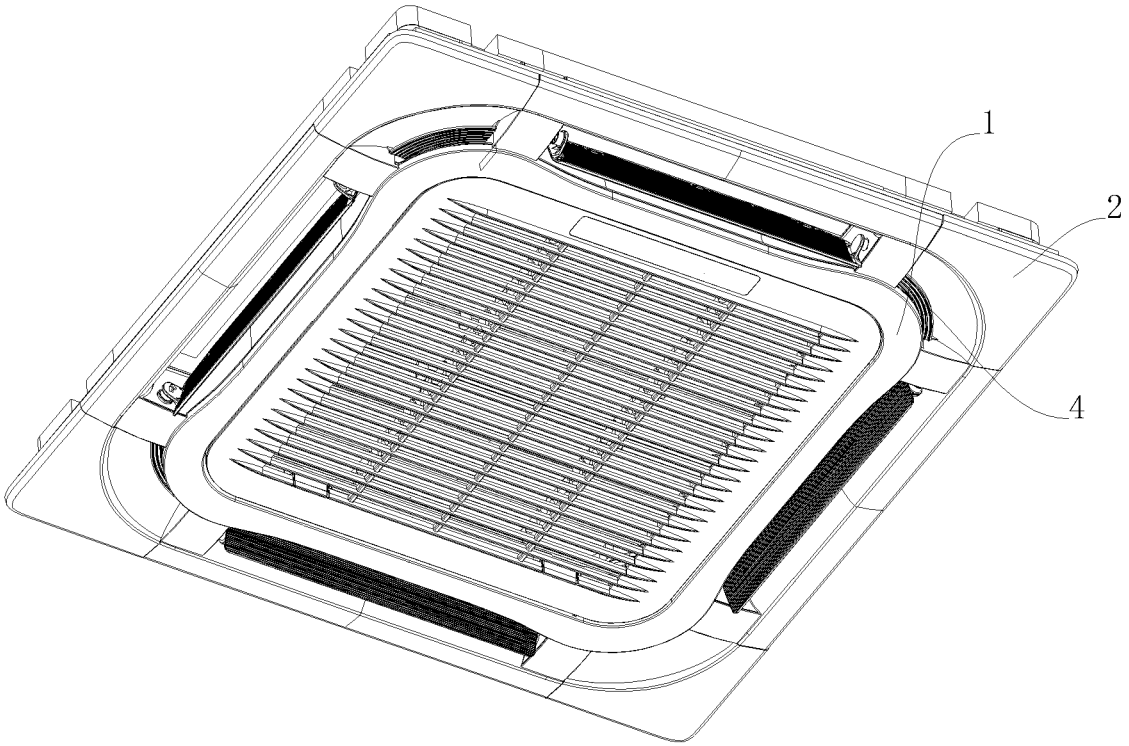
FIG. 4 shows the air outlet panel described in Embodiment 3.
Figure 5:
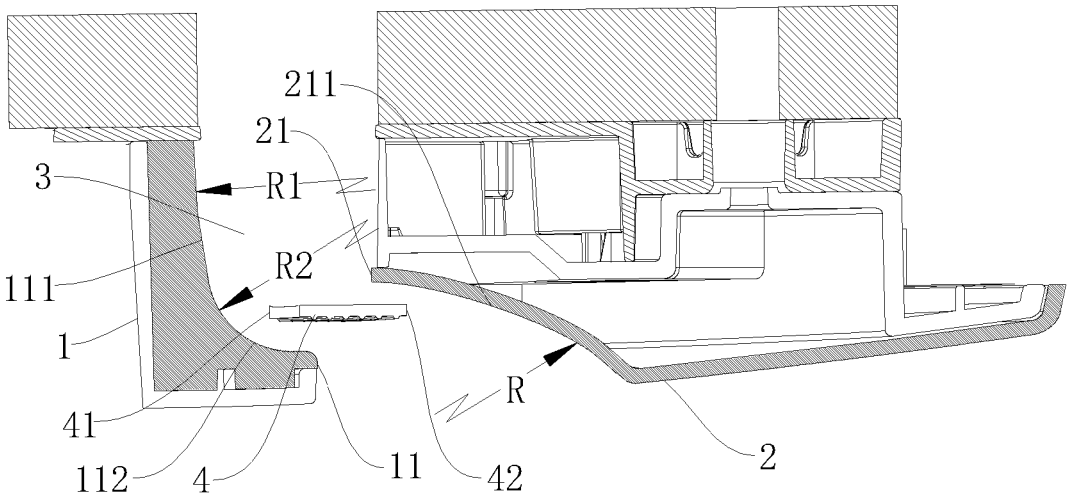
FIG. 5 shows a cross-sectional view I of a partial structure of the air outlet panel shown in FIG. 4.

As shown in FIGS. 4 and 5, on the basis of Embodiment 1, in order to further enlarge the size of the air outlet of the air outlet passage 3, a flow guide structure 4 is provided between the corner cover plate 2 and the panel body 1.

In a direction from a center of the air outlet panel to an outer edge of the air outlet panel, the flow guide structure 4 partially overlaps with the panel body 1 and the corner cover plate 2, or, the flow guide structure 4 partially overlaps with the panel body 1 or the corner cover plate 2.

In other embodiments, in a direction from a center of the air outlet panel to an outer edge of the air outlet panel, one end 41 of the flow guide structure 4 proximate to the center of the air outlet panel is adjacent to one end 11 of the panel body 1 away from the center of the air outlet panel, and, one end 42 of the flow guide structure 4 away from the center of the air outlet panel is adjacent to one end 21 of the corner cover plate 2 proximate to the center of the air outlet panel. With the above-described design method, it is possible to avoid that a desired effect is not achieved due to the occurrence of air leakage.

In other embodiments, in a direction from a center of the air outlet panel to an outer edge of the air outlet panel, one end 41 of the flow guide structure 4 proximate to the center of the air outlet panel is adjacent to one end 11 of the panel body 1 away from the center of the air outlet panel, or, one end 42 of the flow guide structure 4 away from the center of the air outlet panel is adjacent to one end 21 of the corner cover plate 2 proximate to the center of the air outlet panel. With the above-described design method, it is possible to avoid that a desired effect is not achieved due to the occurrence of air leakage.

In some embodiments, in a direction from a center of the air outlet panel to an outer edge of the air outlet panel, the size of an overlapping portion of the flow guide structure 4 and the panel body 1 is less than or equal to 2 mm; and, in a direction from a center of the air outlet panel to an outer edge of the air outlet panel, the size of the overlapping portion of the flow guide structure 4 and the corner cover plate 2 is less than or equal to 2 mm. In some embodiments, in a direction from a center of the air outlet panel to an outer edge of the air outlet panel, the size of an overlapping portion of the flow guide structure 4 and the panel body 1 is less than or equal to 2 mm; or, in a direction from a center of the air outlet panel to an outer edge of the air outlet panel, the size of the overlapping portion of the flow guide structure 4 and the corner cover plate 2 is less than or equal to 2 mm. With the above-described design method, it is possible to avoid the problem of an excessive air resistance and an insufficient air volume due to an excessive overlapping area.

The specific structure of the flow guide structure 4 is as follows:

The flow guide structure 4 includes one flow guide plate or a plurality of flow guide plates arranged along an airflow direction.

Figure 7:
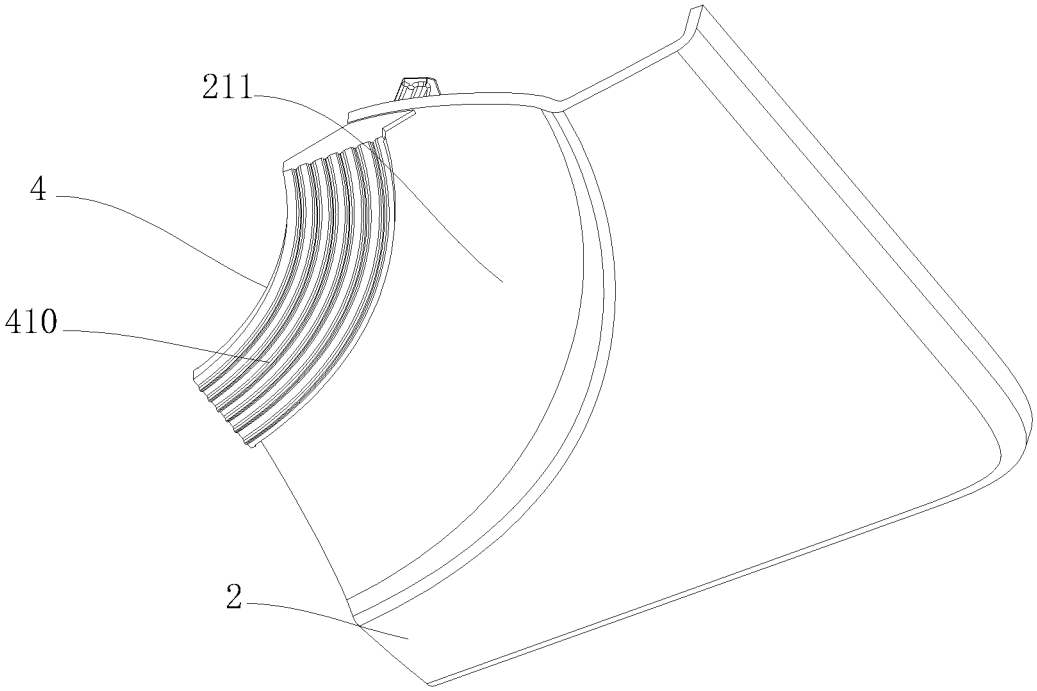
FIG. 7 shows a schematic view of the partial structure shown in FIG. 5.

As shown in FIGS. 5 and 7, when the number of the flow guide plate is one, both ends of the flow guide plate are connected to the corner cover plate 2 through a connecting portion. The connecting portion may be, for example, a connecting plate. A raised structure 410 is provided on a leeward surface of flow guide plate. The air outlet panel is an air outlet panel of the patio type air conditioner. The included angle between the flow guide plate and a horizontal plane is greater than or equal to 0° and less than 90°. The raised structure 410 includes a plurality of strip-like protrusions. In a direction from a center of the air outlet panel to an outer edge of the air outlet panel, a plurality of strip-like protrusions 410 are arranged at intervals from each other. With the function of the protrusion structure 410, it is possible to prevent a condensation phenomenon occurring on a leeward surface of the flow guide plate due to a low air speed.

Figure 6:
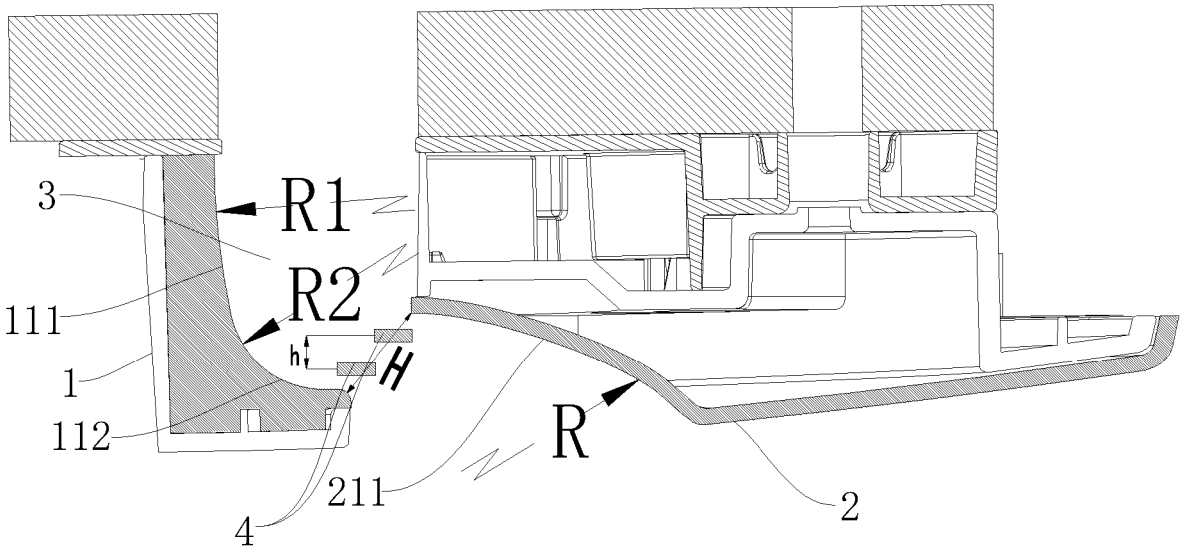
FIG. 6 shows a cross-sectional view II of a partial structure of the air outlet panel shown in FIG. 4.

As shown in FIG. 6, when the number of flow guide plates is two or more, the projection of each flow guide plate along an air direction is continuous, and both ends of each flow guide plate are connected to the corner cover plate 2 through a connecting portion, wherein the included angle between each flow guide plate and a horizontal plane is greater than or equal to 0° and less than 90°.

The spacing of all the flow guide plates when arranged have to meet the following relationship requirements: $h=H/(n+1)$, where h is the spacing between two adjacent flow guide plates, H is the size of the air outlet, and n is the number of the flow guide plates.

After the flow guide structure 4 is additionally provided, it is possible that the size H of the air outlet becomes larger, thereby enlarging the air outlet area. When the airflow within the air outlet passage 3 flows toward the air outlet, the air may first pass through the flow guide structure 4, wherein a flow direction of one part of the air may be changed by the flow guide structure 4 to flow to the third concave curved surface 211, and the other part of the air may bypass to a leeward side of the flow guide structure 4 and flow out after passing through the leeward side.

Preferably, the air outlet panel is the air outlet panel of the patio type indoor unit, and the lowest point of the corner cover plate 2 is set to be higher than the lowest point of the panel body 1, thereby effectively avoiding condensation problem (because if both of them are flush or the lowest point of the corner cover plate 2 is lower than the lowest point of the panel body 1, the air may come out directly from the air duct, so that the flow guide structures for both of them may not work).

Embodiment 4

Figure 8:
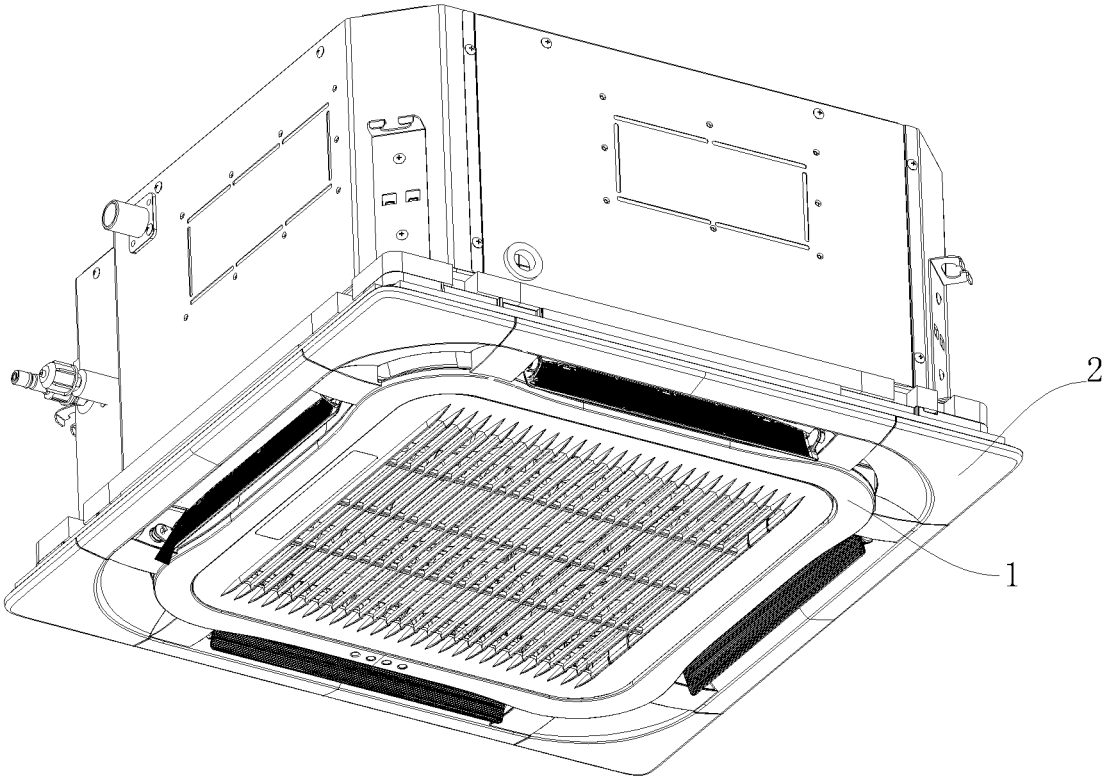
FIG. 8 shows the patio type air conditioner indoor unit according to Embodiment 4.

As shown in FIG. 8, a patio type air conditioner indoor unit includes the above-described air outlet panel.

Those skilled in the art may easily understand that, under the premise that there is no conflict, various optional solutions as described above may be freely combined and superimposed.

It should be understood that, the above-described embodiments are merely exemplary but not restrictive, and those skilled in the art may make various obvious or equivalent modifications or replacements directed to the above-described details without departing from the basic principles of the present disclosure, which will be all included in the scope of the claims of the present disclosure.

What is claimed is:

1. An air outlet panel, comprising a panel body and a corner cover plate disposed at a corner of the panel body, wherein the corner cover plate and the panel body constitute an air outlet duct structure, the air outlet duct structure comprises a first air duct wall and a second air duct wall arranged oppositely, an air outlet passage is formed between the first air duct wall and the second air duct wall, the first air duct wall comprises a plurality of concave curved surfaces connected along an airflow direction, and a plurality of curvature radii of the plurality of concave curved surfaces decrease sequentially along the airflow direction, a part of a lateral surface of the panel body constitutes the first air duct wall, and a part of a lateral surface of the corner cover plate constitutes the second air duct wall, and a corner air outlet of the air outlet panel is formed between the corner cover plate and the panel body; a flow guide structure is provided between the corner cover plate and the panel body, the flow guide structure comprises a plurality of flow guide plates arranged along an airflow direction, each of the plurality of flow guide plates comprises a raised structure comprising a plurality of strip-like protrusions having a length extending along a length of a respective flow guide plate.

2. The air outlet panel according to claim 1, wherein the plurality of concave curved surfaces comprise a first concave curved surface and a second concave curved surface, where a curvature radius of the first concave curved surface is R1, and a curvature radius of the second concave curved surface is R2, wherein a relationship between R1 and R2 is:

$R1=k1*R2, 1.5\leq k1\leq 2$, and $150\text{ mm}\leq R1\leq 250\text{ mm}, 50\text{ mm}\leq R2\leq 150\text{ mm}$; or $R1=k1*R2, 1.5\leq k1\leq 2$; or $150\text{ mm}\leq R1\leq 250\text{ mm}, 50\text{ mm}\leq R2\leq 150\text{ mm}$.

3. The air outlet panel according to claim 2, wherein the second air duct wall comprises a third concave curved surface disposed proximate to an air outlet of the air outlet duct, and a curvature radius of the third concave curved surface is R, wherein a relationship between R and R2 is:

$R=k2*R2, 3\leq k2\leq 4$, and $150\text{ mm}\leq R\leq 550\text{ mm}$; or $R=k2*R2, 3\leq k2\leq 4$; or $150\text{ mm}\leq R\leq 550\text{ mm}$.

4. The air outlet panel according to claim 1, wherein one end of the corner cover plate proximate to a center of the air outlet panel is closer to the center of the air outlet panel than one end of the panel body away from the center of the outlet panel; or in a direction from the center of the air outlet panel to an outer edge of the air outlet panel, one end of the corner cover plate proximate to the center of the air outlet panel is adjacent to one end of the panel body away from the center of the air outlet panel.

5. The air outlet panel according to claim 1, wherein the air outlet panel is an air outlet panel of a patio type indoor unit, and the lowest point of the corner cover plate is higher than the lowest point of the panel body.

6. The air outlet panel according to claim 1, wherein in a direction from a center of the air outlet panel to an outer edge of the air outlet panel, the flow guide structure partially overlaps with the panel body and the corner cover plate, or the flow guide structure partially overlaps with the panel body or the corner cover plate; or in the direction from the center of the air outlet panel to the outer edge of the air outlet panel, one end of the flow guide structure proximate to the center of the air outlet panel is adjacent to one end of the panel body away from the center of the air outlet panel, and one end of the flow guide structure away from the center of the air outlet panel is adjacent to one end of the corner cover plate proximate to the center of the air outlet panel; or in a direction from the center of the air outlet panel to the outer edge of the air outlet panel, one end of the flow guide structure proximate to the center of the air outlet panel is adjacent to one end of the panel body away from the center of the air outlet panel, or one end of the flow guide structure away from the center of the air outlet panel is adjacent to one end of the corner cover plate proximate to the center of the air outlet panel.

7. The air outlet panel according to claim 6, wherein in the direction from the center of the air outlet panel to the outer edge of the air outlet panel, a size of an overlapping portion of the flow guide structure and the panel body is less than or equal to 2 mm, and in the direction from the center of the air outlet panel to the outer edge of the air outlet panel, a size of an overlapping portion of the flow guide structure and the corner cover plate is less than or equal to 2 mm; or in the direction from the center of the air outlet panel to the outer edge of the air outlet panel, a size of an overlapping portion of the flow guide structure and the panel body is less than or equal to 2 mm; or in the direction from the center of the air outlet panel to the outer edge of the air outlet panel, a size of an overlapping portion of the flow guide structure and the corner cover plate is less than or equal to 2 mm.

8. The air outlet panel according to claim 1, wherein the raised structure is provided on a leeward surface of the flow guide plate.

9. The air outlet panel according to claim 8, wherein in a direction from a center of the air outlet panel to an outer edge of the air outlet panel, the plurality of strip-like protrusions are arranged at a plurality of intervals from each other.

10. The air outlet panel according to claim 1, wherein the air outlet panel is an air outlet panel of a patio type air conditioner indoor unit, and an included angle between the flow guide plate and a horizontal plane is greater than or equal to 0° and less than 90°.

11. A patio type air conditioner indoor unit, comprising the air outlet panel according to claim 1.

* * * * *